United States Patent [19]

Higgins

[11] 4,150,794

[45] Apr. 24, 1979

[54] LIQUID JET CUTTING NOZZLE AND HOUSING

[75] Inventor: Bobby L. Higgins, Dallas, Tex.

[73] Assignee: Camsco, Inc., Richardson, Tex.

[21] Appl. No.: 819,190

[22] Filed: Jul. 26, 1977

[51] Int. Cl.[2] ..... B05B 1/00

[52] U.S. Cl. ..... 239/596; 239/600

[58] Field of Search ..... 239/589, 596, 600, 601, 239/591

[56] References Cited

U.S. PATENT DOCUMENTS

| | | | |
|---|---|---|---|
| 2,987,262 | 6/1961 | Goyette et al. | 239/596 X |
| 3,750,693 | 12/1972 | Franz | 239/600 |
| 3,750,961 | 8/1973 | Franz | 239/596 |
| 3,756,106 | 9/1973 | Chadwick et al. | 239/601 X |
| 3,997,111 | 12/1976 | Thomas et al. | 239/596 |

*Primary Examiner*—James B. Marbert

*Attorney, Agent, or Firm*—Sughrue, Rothwell, Mion, Zinn and Macpeak

[57] ABSTRACT

A high-velocity liquid jet cutting nozzle and housing for use with high-pressure fluid sources is disclosed. The nozzle housing eliminates the use of elastically deformable collars by having a nozzle mount of a material which yields only under the pressure of the liquid in the system. The nozzle mount extends downstream of the nozzle element and provides a yielding support, under pressure, for the nozzle element in the direction of fluid flow. The nozzle element, constructed from a jewel, typically sapphire, is thereby supported in a mounting element in a yieldable high-pressure seal when in operation. Different configurations can be used to produce a variety of cutting streams, depending on the material to be cut.

10 Claims, 11 Drawing Figures

FIG. 1 PRIOR ART
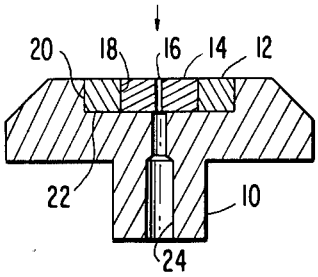
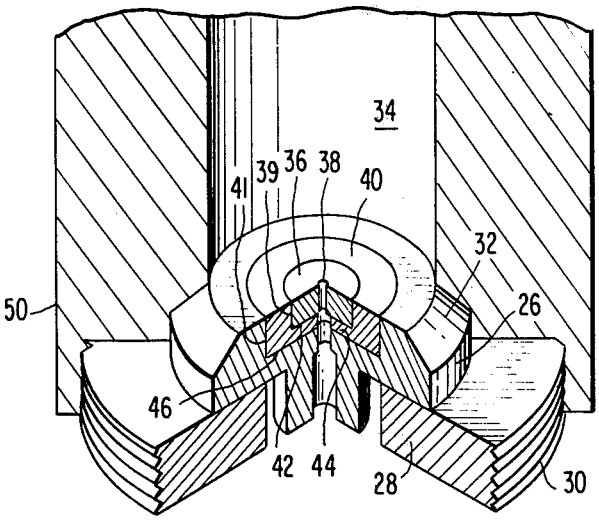
FIG. 2
FIG. 3
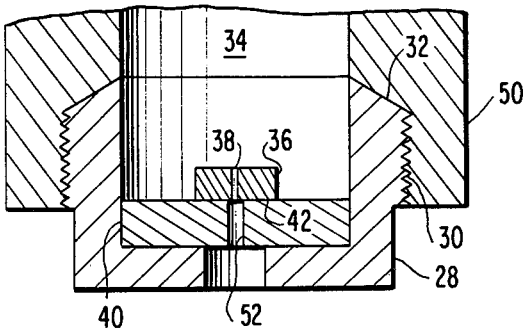
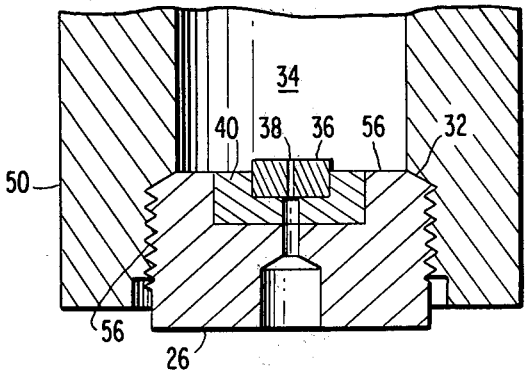
FIG. 5
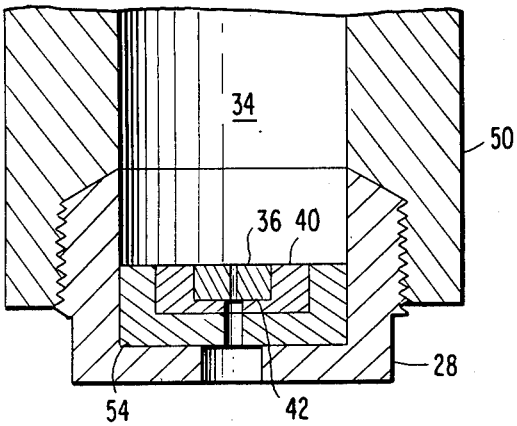
FIG. 4

FIG. 6A
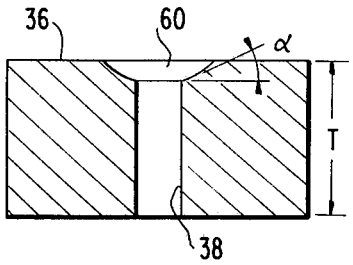
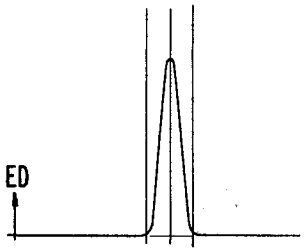
FIG. 6B
FIG. 7A
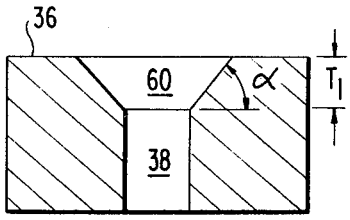
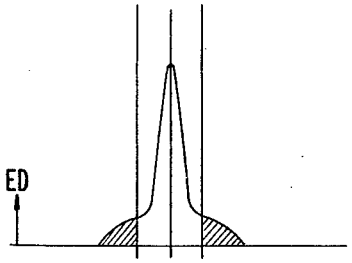
FIG. 7B
FIG. 8A
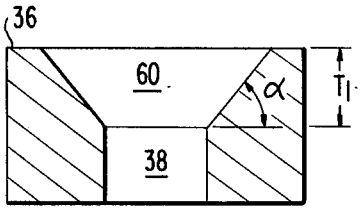
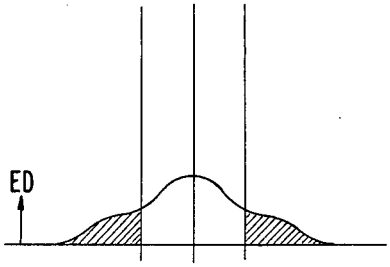
FIG. 8B

LIQUID JET CUTTING NOZZLE AND HOUSING

BACKGROUND OF THE INVENTION

1. Field of the Invention

This invention relates to high-velocity liquid jet cutting and, in particular, an improved nozzle and mounting assembly.

2. Prior Art

The use of fluid jets for cutting has been the subject of continuous experimentation and refinement. Fluid jets for cutting, drilling and the like are well known and utilized for hydraulic mining and other rough cut operations. Patents such as Chaney, U.S. Pat. No. 3,554,602, and Goodwin, et al., U.S. Pat. No. 3,419,220, are typical of a host of prior art which recognizes the use of fluid cutting as a basic technique. More recently, with the advent of computer technology, fluid jet cutting has reached a refined state where, by the use of collimated jet streams, cutting with a narrower kerf is possible providing a better finish along cut surfaces. Accordingly, fluid jet cutting has found application in such commercial areas as high-quality mass production cutting of shoe inner liners and soles, dress patterns and the like. A typical system is found in U.S. Pat. No. 3,978,748 wherein a composite fluid jet computerized cutting system is shown. In such systems, the movement of the jet is controlled by computer such that cutting paths across the cutting table are maximized for production output.

One area of continuing research in fluid jet cutting is the problem of dispersion of the jet, both as it leaves the nozzle and also as it passes through materials to be cut. Accordingly, the prior art is replete with a number of concepts for avoiding dispersion to thereby reduce the wetting of the material being cut and provide a better finish along the surfaces so cut by the high-pressure nozzle.

One prior art attempt is shown in Franz, U.S. Pat. No. 3,750,961. In that patent, a high-velocity fluid jet nozzle is shown utilizing a heavy walled vitreous body having a jet orifice of substantially greater length than the cross-section diameter of the orifice itself. The orifice is defined by a smooth surface which blends into an entry chamber defined by the vitreous body. This system attempts to reduce the problem of dispersion by careful contouring and the reduction of upstream hydrodynamic turbulence.

Another approach is shown in Chadwick, et al., U.S. Pat. No. 3,756,106, where a corundum crystal having an orifice of specific geometry is capable of producing a well-defined fluid cutting jet. While all of these prior art nozzles are directed toward the achievement of a better shaped jet by providing carefully contoured surfaces of particular geometric relationships, one problem which remains is that of leakage around the nozzle elements themselves.

A recent attempt at providing a collimated jet stream which reduces kerf widths, thereby improving the finish of the cut surfaces, is shown in Thomas, et al., U.S. Pat. No. 3,997,111. In Thomas, et al., collimation of the jet occurs by having a housing interconnected between the source of fluid under pressure and the nozzle. The housing defines a flow collimating chamber located directly upstream of the nozzle to receive the liquid from the high-pressure generating equipment and deliver the liquid directly to the chamber for expulsion. This flow chamber which provides the collimation function is of a specific ratio to the discharge opening of the nozzle. Thomas, et al. specifies the minimum ratio of the cross-sectional area of the flow chamber to be one hundred times that of the discharge opening of the nozzle, and preferably greater than two hundred times that of the nozzle. An outside range is approximately 1400 times as set forth in the specification of that patent. While collimation occurs producing very narrow diameter jets, in actual practice, the system defined in U.S. Pat. No. 3,997,111 has been susceptible to various mechanical breakdown phenomena. In order to improve the problems of nozzle handling and leakage about the nozzle, Thomas, et al. utilizes a washer or mounting ring about the sapphire nozzle such that a deformation takes place when the system is under pressure. The sapphire nozzle in Thomas, et al, is mounted in an elastically deformable washer or mounting ring. This ring is to provide a seal between the nozzle element and the nozzle housing and to exert uniform pressure radially to the sides of the nozzle element. This elastic ring, accordingly, is designed to prevent cracking of the sapphire nozzle element or damage to it, and to reduce the tolerance requirements between the lateral surface of the counterbore and the lateral surface of the nozzle element, and to provide an adequate seal between the nozzle element and the bottom wall of the nozzle housing against which the nozzle element rests.

SUMMARY OF THE INVENTION

This invention is an improvement to the above-referenced prior art systems for mounting fluid jet nozzles. It is usable in conventional fluid jet cutting systems of the type disclosed in U.S. Pat. No. 3,978,748 wherein a source of high-pressure fluid, such as an intensifier, is used, and the nozzle is mounted on a movable carriage. Various high-pressure linkages are utilized to convey fluid under pressure from the intensifier to the nozzle for subsequent discharge as a high-velocity, extremely small diameter jet.

The present invention eliminates the need for the elastic washer surrounding the sapphire or jewel element nozzle. Specifically, this invention is premised on the recognition that a mounting ring, such as shown in Thomas, et al., is not needed and that the nozzle housing will provide an acceptable seal without sub-surface leaks to produce an acceptable liquid jet. The applicant has found that, in fact, a seal can be formed between the surface of the nozzle element and the surface of the recess in the nozzle mount against which it rests. By use of appropriate mounting techniques, the nozzle element can be housed in a member which extends about the nozzle element and downstream of it. Accordingly, upon the applicaton of high-pressure fluid upstream of the surface of the nozzle, for example, in the range of 60,000 psi, the force applied to the upstream side of the nozzle element by this source of high-pressure liquid is balanced by an equal and opposite force applied at the downstream side of the nozzle by the housing. Since the surfaces of the nozzle element and the nozzle housing are flat and are pressed together by the high-pressure liquid, a seal is formed. The existence of any leak between the jewel nozzle and its mount will degrade the energy distribution of the jet. Accordingly, the elimination of such leaks—that is, sub-surface leaks—is crucial in maintaining acceptable performance. By appropriate choice of material, the seal is enhanced to form a coined mating surface. Alternatively, the seal can be formed if the bearing surfaces are made sufficiently flat by precision machining. Accordingly, the nozzle need not be surrounded in an elastic collar.

Additionally, prior art nozzles have been found to be unsatisfactory in actual commercial operation. This is because an elastic material changes shape under pressure, and when relaxed, assuming its original shape may physically move the nozzle. Accordingly, the nozzle element tends to be displaced from its desired position—that is, in intimate contact with the nozzle housing—thereby creating a number of undesirable effects. For example, a leak under the nozzle element may occur, extrusion of the washer material itself under the nozzle element may occur, or a catastrophic upset of the entire nozzle element may result, resulting in a loss of the fluid jet stream with resulting damage to the nozzle housing and the possible fracturing of the nozzle element itself. These serious problems are amplified in the realm of rapid duty cycling of the system when on-off times are a few milliseconds, typically in the range of 30–50 milliseconds. Accordingly, the use of an elastic mounting washer has found practical utility only in the handling of the nozzle elements in their housing assemblies or in stable operating conditions without rapid cycling.

This handling function is important because the nozzle element must be of a substantial hardness to minimize erosion or wear due to liquid flow. Generally, materials such as sapphire have been used, and the outside diameter of this jewel element is generally only about 5–10 times that of the orifice diameter. Accordingly, nozzle elements tend to be in the range of approximately 0.05–0.15 inches and are not readily handled.

Accordingly, it is an object of this invention to provide a fluid jet cutting system nozzle mount having improved characteristics in high cycling rate environments with predictable jet stream characteristics.

It is another object of this invention to provide for a firm mounting of the nozzle to facilitate handling of the nozzle elements.

Yet another object of this invention is to provide for a high-pressure liquid cutting jet nozzle mount that eliminates sub-surface leaks.

A further object of this invention is to provide parameters for different fluid jet characteristics to produce different fluid jet streams.

These and other objects of this invention will be described with relation to the drawings and the preferred embodiments thereof.

BRIEF DESCRIPTION OF THE DRAWINGS

FIG. 1 is a side view of a prior art nozzle housing assembly as shown in U.S. Pat. No. 3,997,111.

FIG. 2 is a perspective side view of the nozzle housing assembly made in accordance with this invention.

FIG. 3 is a side view of a second preferred embodiment of the nozzle housing assembly of the present invention.

FIG. 4 is yet another preferred embodiment of the nozzle housing assembly of this invention.

FIG. 5 is a fourth preferred embodiment of a nozzle housing assembly made in accordance with the teachings of this invention.

FIGS. 6A–8B show alternate embodiments of different nozzle configurations and related energy density plots as a function of stream cross-sections.

DESCRIPTION OF THE PREFERRED EMBODIMENTS

Referring now to FIG. 1, this invention is a direct development of the prior art taught in Thomas, et al. FIG. 1 is a simplified side view of the nozzle housing assembly shown in FIG. 3 of U.S. Pat. No. 3,997,111. Accordingly, the teachings of Thomas, et al. show a nozzle housing 10 holding a mounting ring 12 and a nozzle element 14. High-pressure fluid enters the system in the direction shown by the arrow in FIG. 1 and is collimated upstream of the arrow to form a high-pressure jet. Nozzle 14 has an opening 16 to receive the high-pressure fluid. The nozzle is conventionally fashioned from sapphire and is held in place by a mounting ring 12 formed of an elastically deformable material. This mounting ring is set in the nozzle housing 10 to define seal areas between the corresponding elements Accordingly, a first seal area 18 is defined annularly between the elastic ring and the nozzle 14. A second concentric seal area 20 is defined between the mounting ring 12 and nozzle housing 10, and a third transversely extending seal area 22 is defined perpendicular to the nozzle opening 16. An exit port 24 is utilized to discharge the thusly formed high-pressure stream.

As previously indicated, the nozzle mount shown in the prior art FIG. 1 has shown a propensity to leak under the nozzle area—that is, in the area of seal 22. Additionally, the deformable mounting ring 12 has tended to, under pressure, extrude into the seal area 20 thereby reducing the area of seal between the nozzle element 14 shown as seal 18. Moreover, deformation of elastic material has caused displacement of the nozzle element 14 relative to the discharge opening 24.

Turning now to FIG. 2, a first preferred embodiment of this invention is shown which eliminates the deformable mounting ring 12. As shown in FIG. 2, the nozzle housing 26 is secured in a support 28. The support has a threaded portion 30 for threading of the support and allied internal structure into an upstream pipe not shown. The housing 26 can be fashioned of a steel material, such as 300 series CRES. A first high-pressure seal is formed between the nozzle housing and the threaded support element 26 along surface 32. This seal is applied by the use of a mounting nut, not shown, which is threaded onto an upstream pipe 34 which contains the nozzle housing. The nozzle element itself, 36, fashioned typically from sapphire, is a disc of approximately 0.090 inches. It may typically range from 0.050–0.150 inches and has an internal bore constituting a jet shaping port 38. The diameter of that shaping port is in the range of approximately 0.003–0.015 inches.

A nozzle mount 40 is used to position and seat the nozzle 36 in the housing 26. The nozzle mount is formed from a material which, although relatively hard, tends to yield slightly under the influence of high pressure. Accordingly, with the application of fluid pressure in the range of 60,000 psi, the nozzle 36 tends to be impressed upon the mount 40 creating a seal about the surface 42.

Because the nozzle mount 40 is set in the housing 26 and this element is of a harder material than the mount 40, a support is formed for the mount by the harder material which will withstand the sliding contact forces applied during installation. A suitable material for the mount is one which has a yield strength in proportion to the working pressure of the fluid. Such an element allows firm placement of the nozzle element in the mount, yet provides for a good sealing surface. In view of the relatively small size of the nozzle element, the increased size of the mount provides an adequate technique for handling of those elements when not in the mount itself. Additionally, because the nozzle mount has a section 44 disposed immediately downstream of the nozzle element 36, a sealing surface of compatible yielding material is provided along surface 42 backed up by nozzle housing 26 without the problems of deformation and elastic recovery in the prior art. This section eliminates the problem of the washer extruding into the seal area. Also, the use of the harder steel material in the nozzle mount 26 provides a third sealing area 44 between the housing mount 26 and the nozzle housing 40. A small radial clearance shown as surface 39 in FIG. 2, typically of the order of 0.001–0.003 inch, is provided between the nozzle element 36 and the nozzle mount 40 to prevent cracking or other structural damage to the nozzle element due to radial yielding deformation of the nozzle mount when subjected to the high-pressure fluid.

In operation, high-pressure fluid in the realm of 40,000–60,000 psi is fed to the nozzle element via upstream pipe 34. The nozzle element 36, having a flat surface to contact its housing, is forced down by liquid pressure providing an adequate high-pressure seal such that no liquid will flow around the nozzle element. In this example, a material such as free-machining brass, having a yield strength of about 50,000 psi, can be used for the housing 40. This minimizing of leakage reduces wetting of the material being cut. Additionally, because the housing not only surrounds at surface 39 but additionally provides a yielding bearing surface 42, firm placement of the nozzle element against lateral shifting or displacement is facilitated.

The nozzle element 36 in intimate contact with the nozzle mount 40 prevents leaks which would tend to form in the prior art, for example, between the nozzle element 14 and the housing 10 along the common surface wall 22 as shown in FIG. 1. In this invention, the elimination of contact between the nozzle and the nozzle housing improves control of the liquid jet by eliminating all leaks along that surface. Hence, as shown in FIG. 2, the surface 46 between the nozzle mount and its housing 26 does not in any way involve contact of the nozzle element 36. Additionally, repeated and rapid duty cycling by means of an upstream valve resulting in the cycling of high-pressure liquid through the orifice 38 will not dislodge the nozzle element 36 as is a tendency in prior art designs.

Referring now to FIG. 3, another preferred embodiment is shown wherein the same basic concept—namely, of having the nozzle element bear against a mount for it as opposed to direct contact with the nozzle housing—is shown. In FIG. 3, as in other designs, a support 28 is screwed into a pipe section 50 by means of thread elements 30. The nozzle element 36 has an axial bore 38 aligned with a complementary bore 52 in the mounting plate 40. This alignment is self-centering during operation. A high-pressure seal is formed along surface 32 between the support 28 and the pipe 50. High-pressure cutting fluid in source 34 tends to press the nozzle element 36 into contact along surface 42 with the mounting plate 40. A small amount of grease on surface 42 will hold element 36 in position during assembly. Accordingly, a high-pressure seal is formed between the nozzle element 36 and the support 40 during cutting.

As in the prior examples, the nozzle support plate 40 shown in FIG. 3 is fashioned from a material which will withstand sliding forces applied to it, but will yield slightly under the influence of the fluid pressure.

FIG. 4 shows a variation of the FIG. 2 embodiment wherein the nozzle element 36 is disposed in the housing 40 in the same manner as shown in FIG. 2. Additionally, however, a mounting plate 54 is utilized and interposed between the nozzle housing and the housing mount 28. This plate 54 extends the full circumferential width of the chamber 34 to provide, in a manner shown in FIG. 3, adequate seating for the nozzle housing against the support 28. As in prior examples, the nozzle element 36 has a surface 42 bearing against its mount 40 to provide sealing contact, thereby preventing leakage.

Referring now to FIG. 5, yet another preferred embodiment is shown. In this embodiment, the support pipe element 50 is threaded by internally extending threads 56 to couple the support housing 26 directly to the pipe. The threads 56 extend to the upper surface where the housing joins in forming a common surface with the nozzle element mount 40. A high-pressure seal 32 is formed between the pipe 50 and the support housing 26 in a manner described hereinabove. The nozzle element 36 has a portion raised above the surface 56 defined by the top walls of the support housing 26 and the nozzle mount 40. In this embodiment, the use of a lower support plate 28 is eliminated and the nozzle housing extends contiguous to the outer pipe 50 and is threaded into it by threads 56. As in the prior embodiments, the nozzle element itself, 36 having orifice 38, is disposed in a pressure transfer relationship with the mount 40. Referring now to FIG. 6A, there is shown a first preferred fluid jet nozzle configuration, and in FIG. 6B a plot of energy density for the nozzle of FIG. 6A as a function of cross-section. The nozzle 36 has an orifice 38 with a bevel section either radiused or conical in shape. The angle of the taper is generally in the range of 10–20°. The nozzle, typically fashioned from sapphire, has a height T in the range of 0.030–0.040 inches and the radius of the taper 60 is approximately 0.5 T to a depth of 0.005 inches. The ratio of length/diameter (L/D) for the orifice 38 is in the range of 1.5–2.5.

As shown in FIG. 6B, the energy density (ED) is plotted as a function of cross-section of the nozzle. The nozzle of FIG. **6*a*** will produce a well-collimated beam having a dispersion rate of 1.0–1.2 diameters at 100 diameters nozzle length. At a working pressure of 40,000–60,000 psi, an optimum cutting speed is about 13 inches per second. Because the beam is well shaped, it is suited for low-ply fabrics, homogeneous solids and hard materials.

FIG. 7A shows a second preferred embodiment of the nozzle element 36. The nozzle of this configuration will produce a more dispersed beam having areas of spray as shown in the shaded portions of the energy density plot shown in FIG. 7B. Such a nozzle will be usable for fibrous goods, loose-woven materials and low-density laminates. The jet produced has a high energy density during the center portion of the beam with residual areas at the outside of the jet to sever threads or fibers that are not rigidly held in place by the interior properties of the material.

Such a jet can be accomplished by using the taper configuration of FIG. **6*a* with an L/D ratio reduced to 0.7–1.0. The taper 60** is primarily for purposes of reducing nozzle wear at the upstream section but plays a role in jet shaping. Accordingly, the depth of the taper $T_1$ can be increased from 0.005 to approximately 0.010–0.015. In such a configuration, the L/D ratio is in the range of 1.5–1.8. A nozzle fasioned in accordance with the above-referenced parameters will also produce the beam having the energy density shown in FIG. 7B.

FIG. 8A shows a third nozzle configuration having a broad energy density configuration shown in FIG. 8B. As in the case of FIG. 7B, the area of spray is shown as the shaded portion of FIG. 8B. Such a jet is suitable for very loose-weave materials, multiple ply cutting and elements that tend to move on the cutting table. Although a large degree of dispersion occurs, so long as the jet strength is greater than four times the tensile strength of the material to be cut, adequate cutting will take place. The depth of the taper $T_1$ is approximately 0.015 inches and the L/D ratio is in the range of 0.2–1.5.

As shown in FIG. 8A, the depth of taper is deep relative to the orifice 38. A wide beam of relatively uniform energy density in the cutting region is produced. Since cutting occurs at the edge of the stream as it moves across the material, the jet produced by the nozzle of FIG. 8*b* will having a relatively longer duration of cutting time per cut to insure complete severing of the goods.

It is readily apparent that other configurations and embodiments are present without departing from the essential aspects of this invention. So long as the nozzle element bears directly against a mounting element to provide sealing contact under pressure between those elements, a well-collimated beam will result without the attendant problems of leakage around the nozzle.

I claim:

1. In a high-velocity liquid cutting jet system having a high-velocity nozzle with an orifice emitting a collimated jet of liquid for cutting purposes, a high-pressure conduit to deliver the liquid to the nozzle, a housing for said nozzle, a mounting plate for positioning said nozzle in the housing, the improvement wherein said housing is made from a material that is substantially undeformable at ambient conditions but yields under the working pressure of the liquid and said nozzle being loosely positioned on a portion of said mounting plate, said portion receiving pressure generated by said liquid onto said nozzle in the direction of liquid flow to effectuate a sealing arrangement between said nozzle and said mounting plate.

2. The apparatus of claim 1 wherein said housing is brass.

3. The apparatus of claim 1 further including means coupling said housing to said high-pressure conduit.

4. The apparatus of claim 1 wherein said mounting plate has a recess, said nozzle positioned in said recess.

5. The apparatus of claim 1 wherein said nozzle is placed directly on top of said mounting plate, said housing for said nozzle being treaded into said high-pressure conduit.

6. The apparatus of claim 1 further including a nozzle element mount positioned in said mounting plate, said nozzle element mount having a recessed portion for receiving said nozzle, said nozzle and nozzle element mount defining a flush face in the upstream direction.

7. The apparatus of claim 1 wherein said nozzle is generally cylindrical and having an axial bore therethrough, said nozzle having a tapered surface at the upstream end of the axial bore, said taper having a depth in the range of 0.005–0.015 inches from the upstream surface of said nozzle and said bore having a length to diameter ratio in the range of 0.2–2.5.

8. The nozzle of claim 7 wherein said bore produces a fine collimated jet for cutting homogeneous solids and wherein the length to diameter ratio is in the range of 1.5–2.5 with a taper depth of 0.005 inches.

9. The nozzle of claim 7 wherein said depth of taper is 0.01–0.015 inches and said length to diameter ratio is in the range of 1.5–1.8.

10. The nozzle of claim 7 for producing a wide, high-strength fluid jet wherein said depth of taper is 0.015 inches and said length to diameter ratio is in the range of 0.2–1.5.

* * * * *